US008251715B2

(12) United States Patent
Yeh

(10) Patent No.: US 8,251,715 B2
(45) Date of Patent: Aug. 28, 2012

(54) ELECTRICAL CONNECTOR HAVING LATCHING MEMBERS MANEUVERED BY LEVER

(75) Inventor: Cheng-Chi Yeh, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 371 days.

(21) Appl. No.: 12/689,252

(22) Filed: Jan. 19, 2010

(65) Prior Publication Data

US 2010/0184314 A1 Jul. 22, 2010

(30) Foreign Application Priority Data

Jan. 20, 2009 (TW) ..... 98201004

(51) Int. Cl.
*H01R 12/00* (2006.01)

(52) U.S. Cl. ..... 439/73; 439/330

(58) Field of Classification Search ..... 439/71–73, 439/330–331, 342, 259, 261, 266
See application file for complete search history.

(56) References Cited

U.S. PATENT DOCUMENTS

| | | | | |
|---|---|---|---|---|
| 4,692,790 | A * | 9/1987 | Oyamada | 257/727 |
| 4,761,140 | A * | 8/1988 | Geib | 439/71 |
| 6,685,494 | B1 * | 2/2004 | McHugh et al. | 439/342 |
| 7,014,477 | B2 * | 3/2006 | Tsai | 439/71 |
| 7,179,092 | B2 | 2/2007 | Ma | |

* cited by examiner

*Primary Examiner* — Khiem Nguyen
(74) *Attorney, Agent, or Firm* — Ming Chieh Chang; Wei Te Chung; Andrew C. Cheng

(57) ABSTRACT

An electrical connector is adapted for electrically connecting an electronic package (3) to a circuit board. The electrical connector includes an insulative housing (10) for receiving an electronic package, a stiffener (30) supporting the insulative housing, a pair of latching members (50) mounted on the stiffener and pivotable about a respective first axis therethrough, and a lever (70) mounted on the stiffener and pivotable about a second axis perpendicular to the first axis, the lever being operable to pivot the latching members to a closed position for pressing against the electronic package.

9 Claims, 5 Drawing Sheets

ELECTRICAL CONNECTOR HAVING LATCHING MEMBERS MANEUVERED BY LEVER

BACKGROUND OF THE INVENTION

1. Field of the Invention

The present invention relates to an electrical connector, and particularly to a land grid array socket connector having latching members maneuvered by lever operated between a first position, in which the latching members are opened to receive an IC therein, and a second position, in which the latches are depressed to press down the IC toward the electrical connector.

2. Description of Related Art

U.S. Pat. No. 7,179,092 issued to Ma on Feb. 20, 2007 discloses an electrical connector. The electrical connector comprises a housing, a stiffener surrounding the housing and formed with an engaging portion, a cover rotatably mounted on the housing and having a tongue portion, and a lever engaging with the tongue portion of the cover. When an IC package is received by the housing, the cover is rotated from an open position to a closed position to fasten the IC package at the closed position via engagement between the lever and the engaging portion of the stiffener. The stiffener has a first end and an opposite second end. The cover is mounted at the first end and extends all the way to the second end to facilitate its function of pressing the IC package against the housing.

The IC package is thus depressed by the cover and is fixed at the closed position. It would require a substantial piece of material to produce such a cover.

Hence, an electrical connector having improved latching members is required to overcome the above-mentioned disadvantages of the related art.

SUMMARY OF THE INVENTION

An object of the present invention is to provide an electrical connector using less material.

To achieve the aforementioned objects, an electrical connector is adapted for electrically connecting an electronic package to a circuit board. The electrical connector includes an insulative housing for receiving an electronic package, a stiffener supporting the insulative housing, a pair of latching members mounted on the stiffener and pivotable about a respective first axis therethrough, and a lever mounted on the stiffener and pivotable about a second axis perpendicular to the first axis, the lever being operable to pivot the latching members to a closed position for pressing against the electronic package. The latching member is floatingly mounted to the stiffener at a position adjacent to a position at which the lever is mounted on the stiffener.

The latching members perform a function of depressing or releasing the electronic package. The latching member has a small dimension and does not extend from one side end of the stiffener to the opposite side end of the stiffener. Thus, it would cost less material to manufacture such latching members.

Other objects, advantages and novel features of the invention will become more apparent from the following detailed description of a preferred embodiment when taken in conjunction with the accompanying drawings.

DETAILED DESCRIPTION OF THE INVENTION

Figure 1:
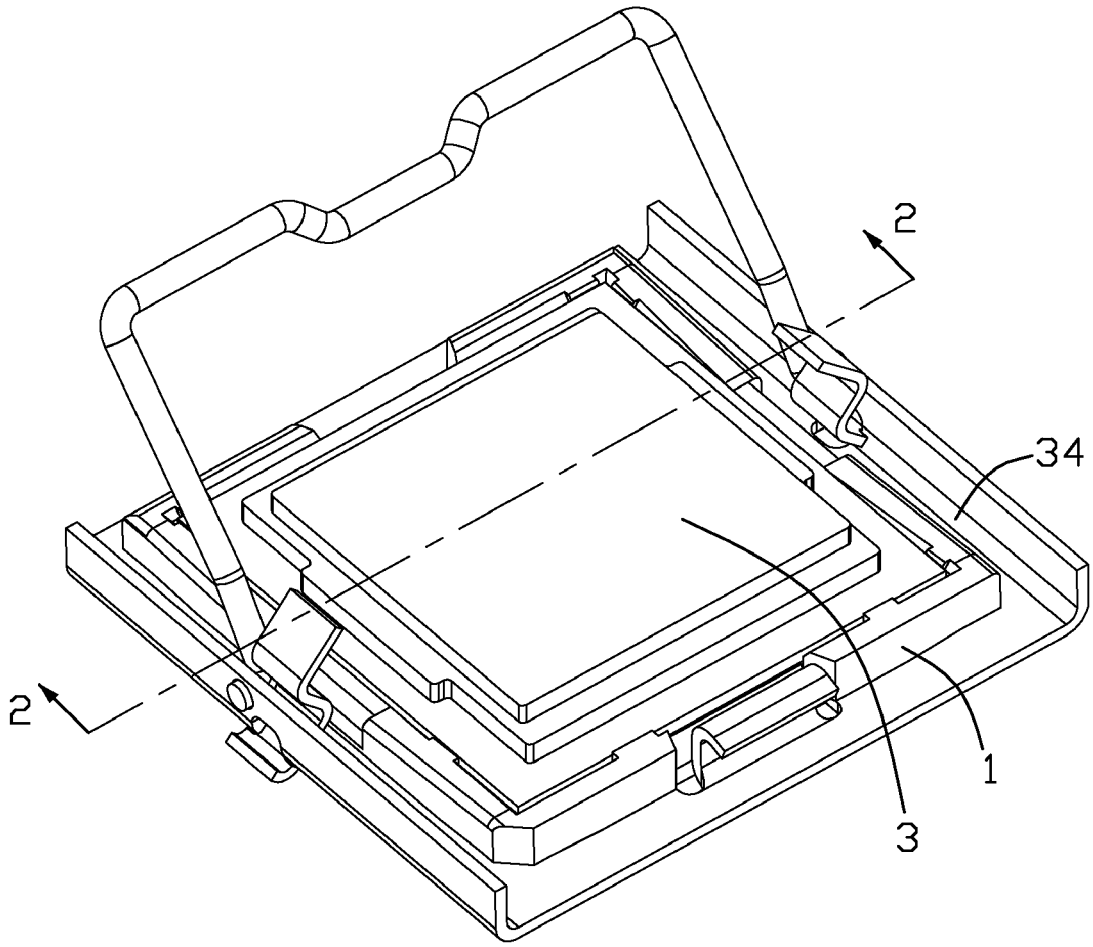
FIG. 1 is an assembled perspective view showing an electrical connector connecting with an IC package in accordance with the present invention, when the latching members are disposed in an opened position.

Reference will now be made to the drawing figures to describe the present invention in detail. Referring to FIGS. 1-5, an electrical connector in accordance with the preferred embodiment of the present invention comprises an insulative housing 10 electrically connecting an IC package 3 to a circuit board (not shown), a stiffener 30 strengthening the insulative housing 10, a pair of latching members 50 and a lever or actuator 70 mounted on the insulative housing 10.

Referring to FIG. 1, the insulative housing 10 comprises a base portion 11, a plurality of side walls 13 rising from the base portion 11, and a receiving cavity 12 defined therebetween. Each side wall 13 defines thereon a cutout 131.

The stiffener 30 comprises a base plate 31 having a pair of opposite first plate portions 311 and a pair of opposite second plate portions 312. The stiffener 30 is formed with a pair of supporting portions 32 rising from the pair of first plate portions 311 of the base plate 31 and a hook portion 33 formed at the second plate portion 312. The stiffener 30 has a receiving space 34 defined between the pair of supporting portions 32. Each stiffener 30 defines thereon a securing hole 36 extending from the first plate portion 311 to the supporting portion 32. Each supporting portion 32 defines thereon a mounting hole 35 adjacent to the securing hole 36.

The latching member 50 comprises a body portion 51, a latching portion or head 53 and a bent portion 52 disposed between the body portion 51 and the latching portion 53. The body portion 51 comprises a resisting portion 55 substantially parallel to the latching portion 53, and a tail portion 56 substantially parallel to the bent portion 52. The resisting portion 55 has a pair of indentations 511 defined at opposite edges of the resisting portion 55, and a connecting portion 512 disposed between the pair of indentations 511 and connected with the tail portion 56. The tail portion 56 has a pair of opposite ends 561 adjacent to the indentations 511 respectively.

The lever 70 comprises a handle 72 and a pair of depressing beams 71 extending downwardly from opposite ends of the handle 72. The handle 72 has a locking portion 73 formed at a middle portion thereof. Each depressing beam 71 has a mounting portion 711 formed at a free end thereof.

Figure 2:
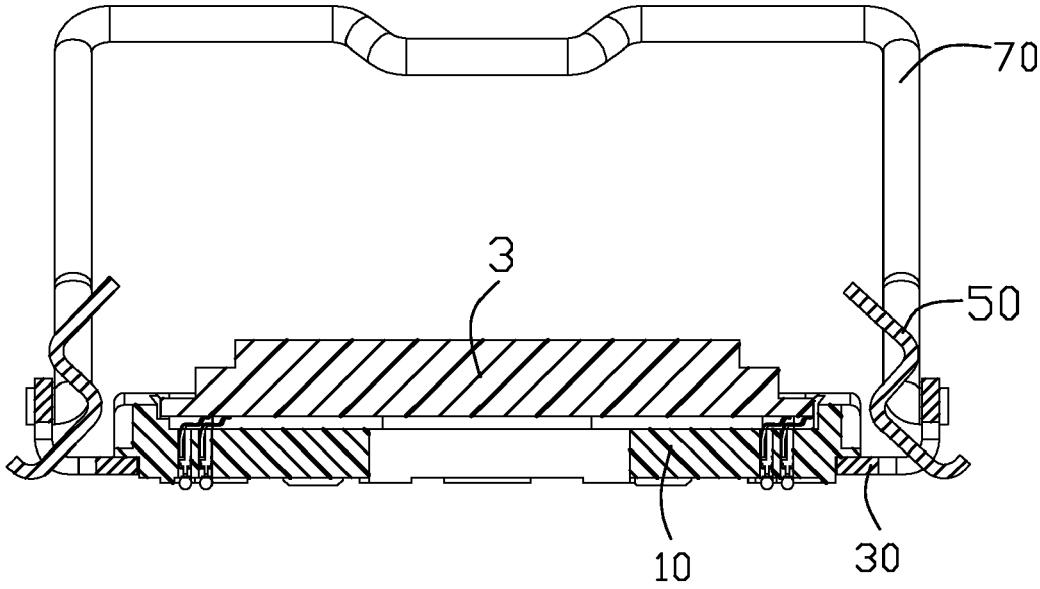
FIG. 2 is a cross-sectional view of the electrical connector and the electronic package, taken along line 2-2 of FIG. 1.
Figure 3:
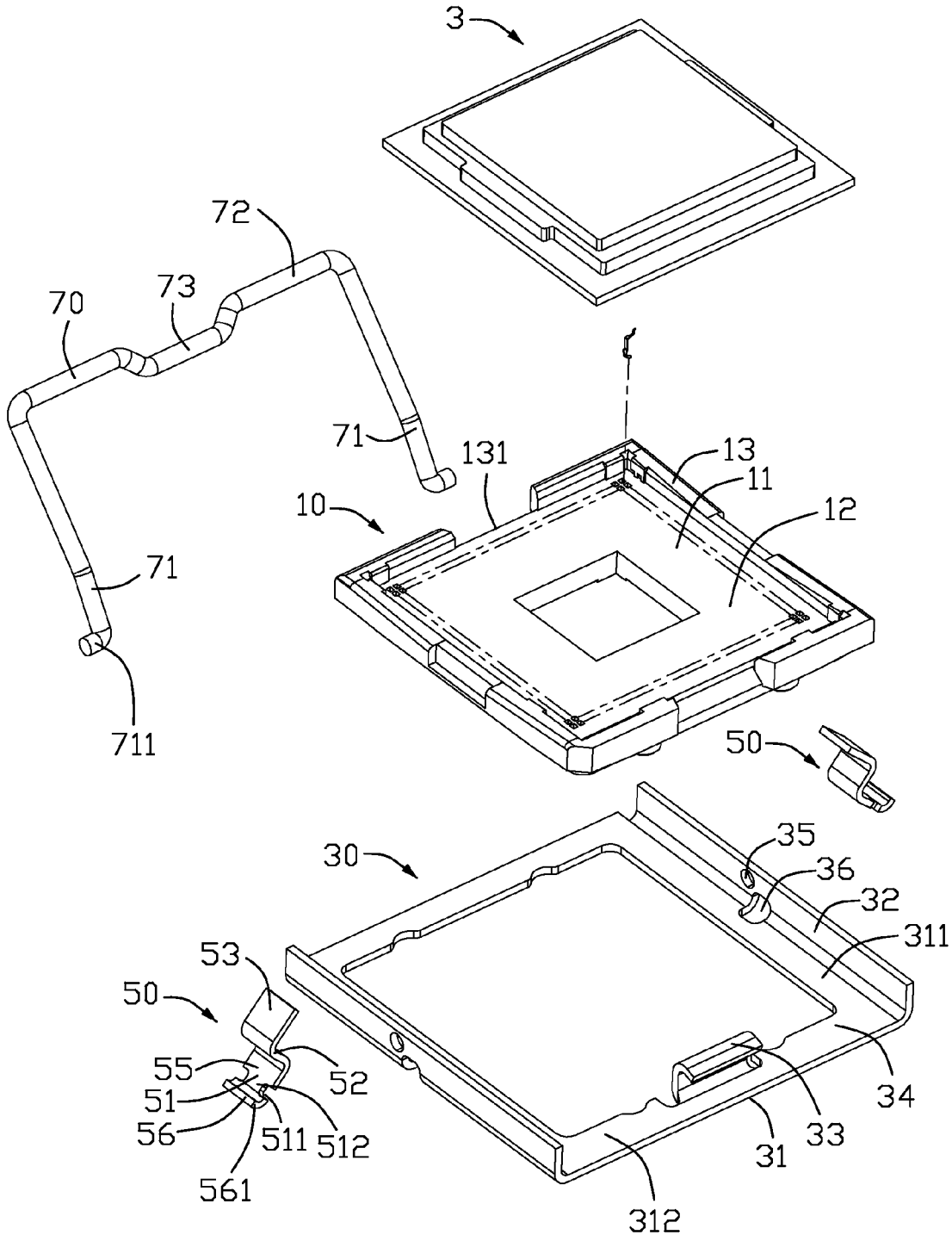
FIG. 3 is an exploded perspective view of the electrical connector and the electronic package as shown in FIG. 1.

Referring to FIGS. 1-3, in assembly of the electrical connector, the opposite ends 561 of the tail portion 56 of the latching member 50 are moveably inserted into the securing hole 36 in sequence. The securing hole 36 extending from the first plate portion 311 to the supporting portion 32 is capable of providing an adequate space for insertion and movement of opposite ends 561 of the tail portion 56. When the tail portion 56 of the latching member 50 is inserted through the securing hole 36 of the stiffener 30, the indentations 511 of the latching members 50 cross over a corresponding securing hole 36. At this position, the tail portion 56 of each latching member 50 is located outside an outer surface of the supporting portion 32. The resisting portion 55 together with the latching portion 53 of the latching member 50 is pivotable about the connecting portion 512 from an opened position toward a closed position.

The lever 70 is assembled to the stiffener 30, with the mounting portions 711 inserted in the mounting holes 35, respectively. The lever 70 is operable to pivot about the mounting portions 711. The insulative housing 10 is received in the receiving space 34 of the stiffener 30. A first axis about which the latching member 50 pivots is perpendicular to a second axis about which the lever 70 pivots.

Referring to FIGS. 1 and 2, when the lever 70 is not depressed by the hook portion 33, i.e., at it open position, the latching members 50 are disposed at the open position. The IC package 3 can be positioned in the receiving cavity 12 of the insulative housing 10.

Figure 4:
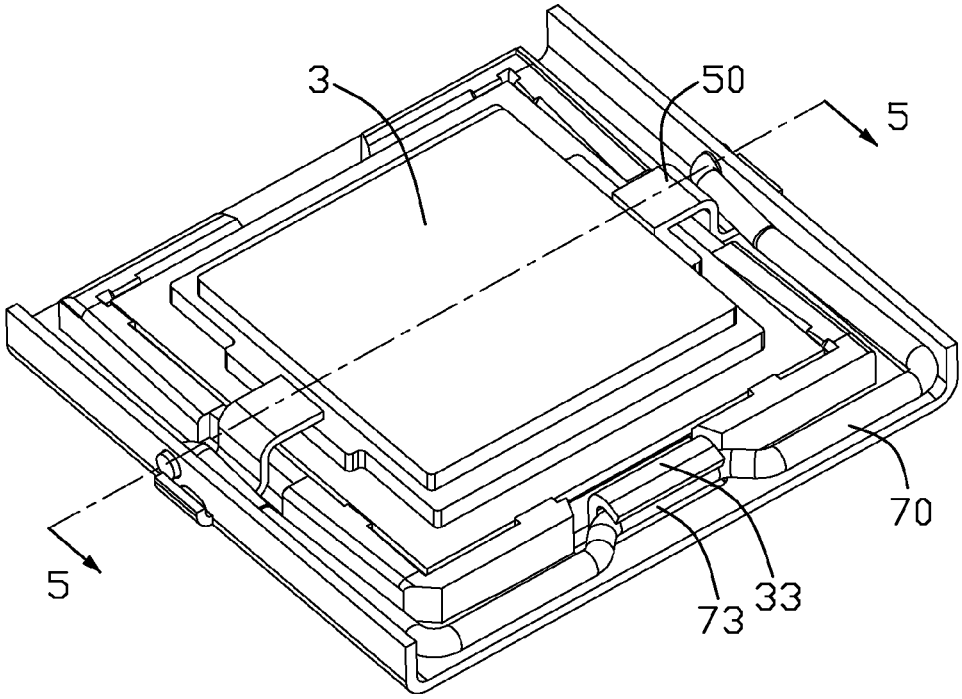
FIG. 4 is an assembled perspective view of the electrical connector and the electronic package as shown in FIG. 1, when the latching members are disposed in a closed position.
Figure 5:
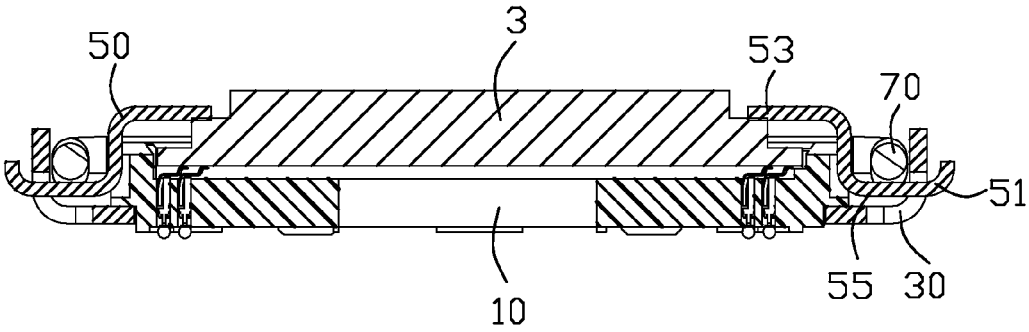
FIG. 5 is a cross-sectional view of the electrical connector and the electronic package, taken along line 4-4 of FIG. 4.

Referring to FIGS. 4 and 5, when the latching members 50 are actuated to the closed position by pivoting the lever 70 to a position adjacent to the latching portion 33, with the depressing beams 71 of the lever 70 depressing against the resisting portions 55 of the latching members 50, the IC package 3 is held firmly by the latching portions 53 of the latching members 50. A resilient force provided by the latching members 50 are exerted onto the IC package 3 within a region adjacent to the securing holes 36. When the IC package 3 is retained at the closed position, the locking portion 73 of the lever 70 is locked with the hook portion 33.

When the IC package 3 is to be removed from the electrical connector, the locking portion 73 is separated and disengaged from the hook portion 33 and the lever 70 is pivoted away from its unlocked position. The depressing beams 71 of the lever 70 are now disengaged from the resisting portions 55 of the latching members 50 to loosen the latching members 50. The IC package 3 could be removed from the electrical connector easily.

The IC package 3 can be firmly fastened to the closed position due to the engagement between the lever 70 and the latching members 50, and can be removed from the electrical connector when the latching members 50 are loosened. The latching member 50 has a small dimension and depresses an outer edge of the IC package 3. A resilient force provided by the latching member 50 is exerted to the IC package 30 within a region adjacent to corresponding securing hole 36 in which the latching member 50 is mounted to realize desired mechanical advantage between load and effort. It would also cost less material to manufacture such latching members 50.

The electrical connector could form only one latching member 50 to fasten the IC package 3. Optionally, the latching members 50 could be formed at the second plate portion 312 on which the hook portion 33 is formed.

However, the disclosure is illustrative only, changes may be made in detail, especially in matter of shape, size, and arrangement of parts within the principles of the invention.

What is claimed is:

1. An electrical connector for electrically connecting an electronic package to a circuit board, comprising: an insulative housing for receiving an electronic package; a stiffener supporting the insulative housing; a pair of latching members mounted on the stiffener and pivotable about a respective first axis therethrough; and a lever mounted on the stiffener and pivotable about a second axis perpendicular to the first axis, the lever being operable to pivot the latching members to a closed position for pressing against the electronic package, wherein said latching member is floatingly mounted to the stiffener at a position adjacent to a position at which the lever is mounted on the stiffener, wherein said latching member is formed with a connecting portion mounted on the stiffener, said latching member being pivotable about the connecting portion, wherein said latching member comprises a latching portion engageable with the electronic package and a body portion enageable with the stiffener and the lever, wherein said lever comprises a pair of depressing beams, and said body portion of the latching member comprises a resisting portion resisted against by the depressing beam of the lever at the closed position.

2. The electrical connector as claimed in claim 1, wherein said latching member has a bent portion bending substantially perpendicularly from the resisting portion and connected to the latching portion.

3. The electrical connector as claimed in claim 1, wherein said stiffener defines a pair of securing holes, and said resisting portion of the latching member defines a pair of indentations at opposite sides of the connecting portion and engaging with the securing hole.

4. The electrical connector as claimed in claim 3, wherein said stiffener defines a pair of mounting holes, and said depressing beam of the lever is formed with a mounting portion inserted in the mounting hole, the lever being pivotable about the mounting portion.

5. The electrical connector as claimed in claim 4, wherein said stiffener comprises a base plate having a pair of opposite first plate portions and a pair of opposite second plate portions, and a pair of supporting portions rising from the first plate portions, and wherein said body portion of the latching member is formed with a tail portion resisting against an outer surface of the supporting portion at the closed position.

6. The electrical connector as claimed in claim 5, wherein said securing hole and the mounting hole are defined on each supporting portion and are disposed adjacent with each other, said securing hole extending from the first plate portion to the supporting portion.

7. The electrical connector as claimed in claim 5, wherein said stiffener has a hook portion formed at the second plate portion, and wherein said lever comprises a handle between the pair of depressing beams, said handle being formed with a locking portion locking with the hook portion of the stiffener at the closed position.

8. An electrical connector assembly comprising: an insulative housing defining a receiving cavity in an upper face thereof for receiving an electronic package; a plurality of contacts disposed in the housing with contact sections upwardly extending into the receiving cavity; a pair of opposite latching members respectively and intimately located by two sides of the housing, each being equipped with a latching head directing transversely toward the receiving cavity; and an actuator disposed around the housing and moveable between a first position where the pair of latching members are essentially released from the actuator in an open manner outwardly away from the receiving cavity to allow installation of the electronic package into the receiving cavity, and a second position where the pair of latching members are essentially forcibly actuated by said actuator in a closed manner inward toward the receiving cavity to efficiently downwardly press the installed electronic package in the receiving cavity, wherein at least one of said actuator and said latching member is pivotally moveable relative to the housing, wherein a metallic stiffener surrounds said housing, and at least one of said actuator and said latching member is mounted to the stiffener rather than to the housing, wherein said pair of latching members are located around a middle portion of the housing where a pivotal axis of said actuator is located.

9. The electrical connector assembly as claimed in claim 8, wherein said actuator extends transversely across the housing while each of said latching members is only at the corresponding side of the housing.

* * * * *